United States Patent [19]

Koo

[11] 4,447,760

[45] May 8, 1984

[54] FILAMENT SWITCHING DEVICE

[76] Inventor: Ronald Koo, 29 Greenwood Rd., Morris Plains, N.J. 07950

[21] Appl. No.: 176,677

[22] Filed: Aug. 11, 1980

[51] Int. Cl.[3] ..... H01J 7/44

[52] U.S. Cl. ..... 315/65; 337/145; 337/150

[58] Field of Search ..... 337/142–157; 315/65

[56] References Cited

U.S. PATENT DOCUMENTS

| | | | |
|---|---|---|---|
| 1,164,603 | 12/1915 | Jonas | 313/156 |
| 1,594,060 | 7/1926 | Huff | 313/156 |
| 2,009,555 | 7/1935 | Mathiesen | 313/156 |
| 2,049,338 | 7/1936 | Trope | 315/65 |
| 2,191,595 | 2/1940 | Spencer | 313/156 |
| 2,217,794 | 10/1940 | Davis | 315/65 |
| 2,278,837 | 4/1942 | DeCastro | 315/65 |
| 2,405,789 | 8/1946 | Homrighous | 337/145 |
| 4,287,452 | 9/1981 | Fernandez | 315/65 |

*Primary Examiner*—Harold Dixon

*Attorney, Agent, or Firm*—Weingram & Klauber

[57] ABSTRACT

A filament switching device is arranged to be mounted within the screw base of a conventional, dual-filament, incandescent light bulb. The device has a frame which branches around the evacuation tube of the bulb thereby allowing sufficient room for switching components within the device and yet avoiding interference with the evacuation tube of the bulb. Mounted within the frame of the switching device is a fixed contact and a cantilevered contact. The cantilevered contact can swing in a direction transverse to the evacuation tube to make electrical contact with the fixed contact. The cantilevered contact is held separated from the fixed contact by a fusible conductor. Upon failure of one of the filaments in the bulb a surge of current flows through the fusible conductor, parting it and allowing the cantilevered contact to swing into electrical contact with the fixed contact. This swing of the cantilevered contact substitutes the failed filament with the other filament.

13 Claims, 10 Drawing Figures

FIG. 1
PRIOR ART
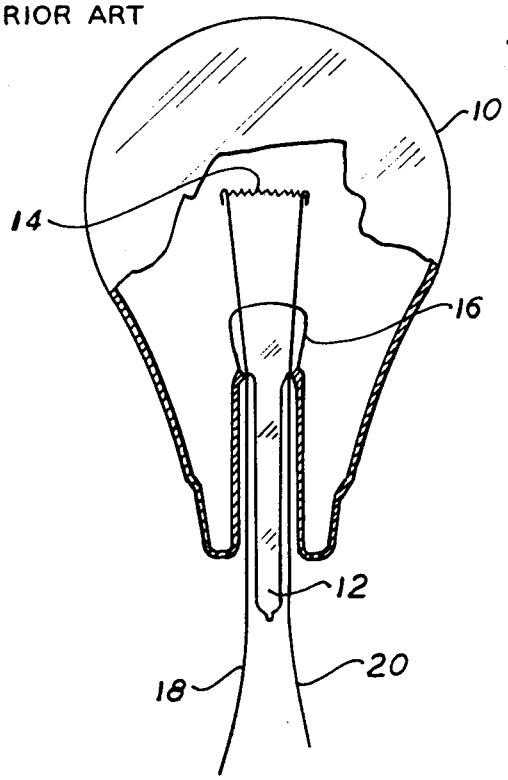
FIG. 3
PRIOR ART
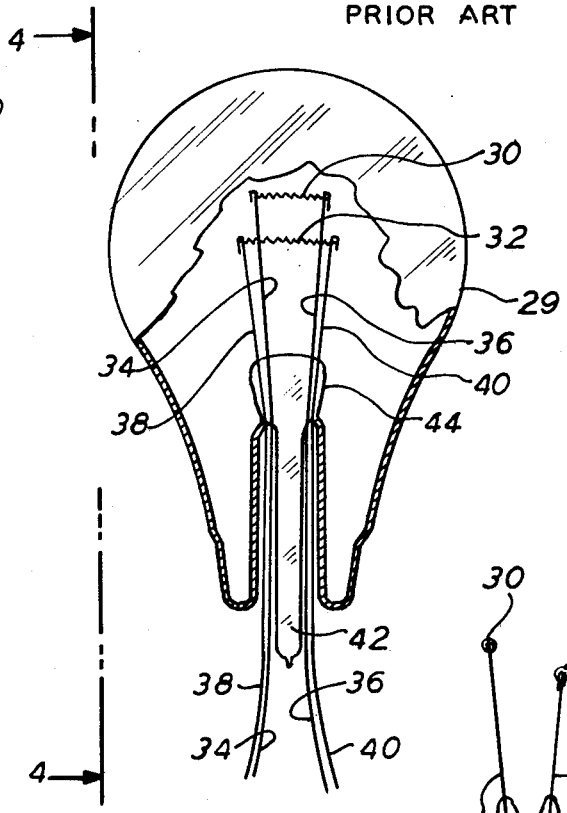
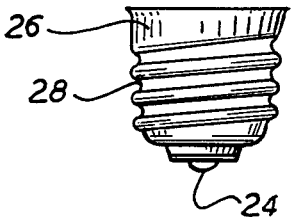
FIG. 2
22 PRIOR ART
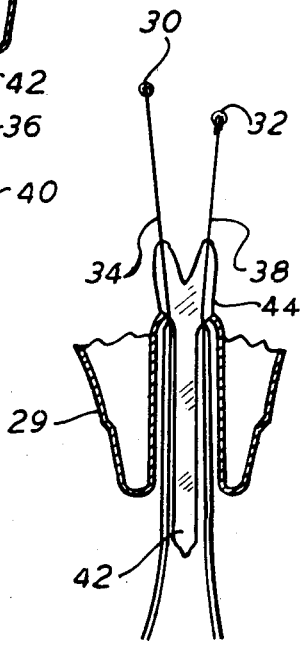
FIG. 4
PRIOR ART
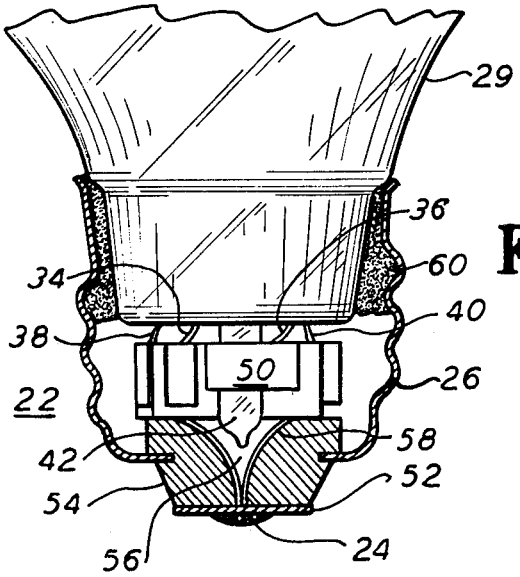
FIG. 5

FILAMENT SWITCHING DEVICE

BACKGROUND OF THE INVENTION

The present invention relates to filament switching devices and in particular to a switching device which is designed to be compactly mounted within the screw base of a conventional electric lamp.

It is known to operate a pair of incandescent filaments so that upon failure of a primary filament an automatic switching device substitutes a secondary filament for the failed primary. A known multi-filament lamp employs a fusible conductor which restrains a spring-leaf contact. Upon failure of a primary filament the surge of current associated with failure ruptures that fusible conductor, releasing the spring-leaf contact and causing it to substitute the secondary filament for the failed primary filament. In another known example of such devices, an insulator which separates a pair of contacts breaks down upon failure of a primary filament and allows these contacts to close and substitute a secondary filament for the failed primary filament.

These known filament switching devices have generally required significant amounts of space within the screw base of a light bulb. Accordingly, manufacturers of light bulbs would require specialized machinery to handle an enlarged screw base. Moreover, the enlargement of the screw base would result in a longer lamp or in a bulb shortened to account for the enlarged screw base. Such a change in dimension or shape can be unacceptable in certain applications. Another practical impediment to successful implementation of a filament switching device has been containment of the fragments resulting from the fusing of the fusible conductor. Known devices have not had provisions for preventing such hot fused fragments from striking the fragile glass bulb. Such inadvertent contact on the glass bulb can cause its breakage which results in air leakage. Therefore, any attempt to commercialize a light bulb having an automatically switched pair of filaments would be unsuccessful.

The present invention avoids such problems and disadvantages by mounting a cantilevered and a fixed contact within a frame having a floor which branches in two directions. Since the frame branches in two directions it can fit around the evacuation tube of a conventional light bulb and thus compactly fit within the conventional screw base of such a bulb. These contacts are employed to automatically substitute another filament for a failed filament. Accordingly, a reliable light bulb can be efficiently and inexpensively manufactured using the conventional size screw base, exhaust tubing, and dual filament mount.

Moreover, since fabrication of a dual filament light bulb is commonplace, the present switching device can be reaily incorporated into existing manufacturing lines without redesign or modification of the dual filament bulbs. Also, since its screw base need not be elongated or enlarged the lamp can maintain its standard length and shape.

Since any incandescent filament has an inherently limited life, the effective life of an incandescent lamp according to the present invention can be doubled without sacrifice in luminous efficacy. This is a significant achievement, since any appreciable extension in filament life of commercial lamps necessitates lowering of the operating temperature of the filament which inevitably decreases luminous efficacy. Therefore, the so-called long life bulbs available commercially are undesirable for energy conservation. But redundancy provides reliability, which is extremely important for applications where it is prohibitively expensive or impractical to routinely rep;ace the light bulbs. Exemplary prior art are U.S. Pat. Nos. 2,049,338 and 2,217,794.

In one embodiment, the frame of the switching device branches in two directions but is bridged by a cross-piece which thereby forms a central passageway. This passageway is sized to receive the evacuation tube so that the switching device is mechanically self-aligning and compactly mounted within the associated screw base. It is also preferable that the frame of the switching device be a pair of complimentary shells shaped to fit together and encompass the fusible conductor, thereby entrapping fused fragments which may issue therefrom.

Preferably, the frame of the switching device contains the cantilevered contact in one branch and the fusible conductor in the other branch. This cantilevered contact can be designed to swing transversely to the axis of the evacuation tube. This latter feature insures that the switching device compactly fits within a conventional screw base.

SUMMARY OF THE INVENTION

In accordance with the illustrative embodiment demonstrating features and advantages of the present invention there is provided in an electric light, a filament switching device. This electric light has a translucent bulb sealing at least two filaments. These filaments are coupled by lead wires into a screw base. The above mentioned filament switching device includes a frame, a fixed contact, a cantilevered contact, a fusible conductor and a holding means. The frame has a floor which branches in two directions. The fixed and cantilevered contacts are attached to the frame. The cantilevered contact is operable to deflect laterally over the floor of the frame. This cantilevered contact is positioned to flex upon separation from the fixed contact. The frame has a holding means for restraining one end of the fusible conductor. Its other end is connected to the free end of the cantilevered contact. This holding means is operable, through the fusible conductor, to separate the cantilevered contact from the fixed contact.

According to an associated method, also in accordance with the present invention, there is provided a method for assembling an electric light. This electric light has a translucent bulb with an axial evacuation tube. The bulb seals a pair of filaments that are coupled by two pairs of lead wires to a screw base by means of the filament switching device. This switching device is mounted in a frame that branches in two directions. The method includes the steps of positioning the frame to straddle the evacuation tube. The method also includes connecting one of the lead wires from each of the pair of filaments to the device. Another step is mounting the screw base on the bulb to encircle the frame.

BRIEF DESCRIPTION OF THE DRAWINGS

The above brief description as well as other objects, features and advantages of the present invention will be more fully appreciated by reference to the following detailed description of the presently preferred but nonetheless illustrative embodiment in accordance with the present invention, when taken in conjunction with the accompanying drawings wherein:

FIG. 1 is an elevational view of a conventional monofilament bulb as known in the prior art;

FIG. 2 is an elevational view of a conventional screw base associated with the apparatus of FIG. 1, as known in the prior art;

FIG. 3 is an elevational view of a conventional dual filament 3-way light bulb as known in the prior art;

FIG. 4 is a fragmentary elevational view along lines 4—4 of FIG. 3;

FIG. 5 is an elevational view, partly in section, of a switching device according to the present invention mounted on a screw base and bulb as shown in FIGS. 2–4;

FIG. 9 is a modification of FIG. 6.

FIG. 10 is a perspective view of a switching device which is an alternate to that of FIG. 6;

DETAILED DESCRIPTION OF THE PREFERRED EMBODIMENT

Figure 6:
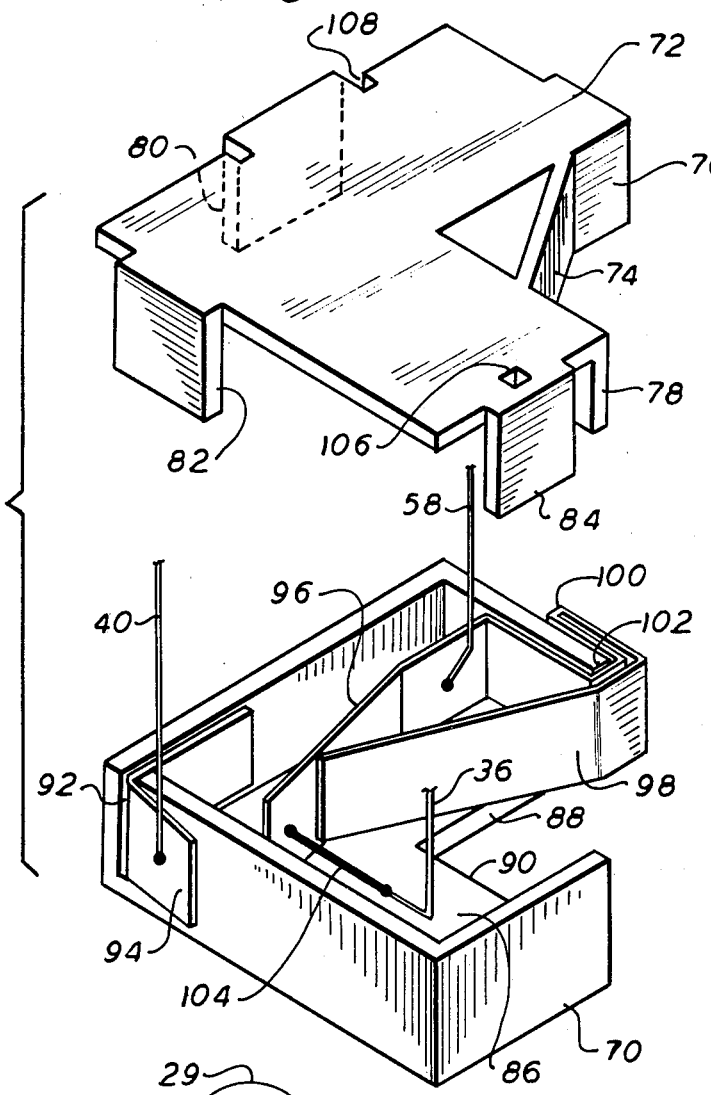
FIG. 6 is an exploded view of the switching device of FIG. 5.

Referring to FIG. 1, a conventional translucent bulb 10 is shown fragmented to expose an evacuation tube 12. This known device has an evacuation tube 12 which is flattened at its upper end 16 to provide a mounting base for imbedded lead wires 18 and 20 which support incandescent filament 14. Referring to FIG. 2 there is shown a conventional dual terminal screw base to which the lead wires of the incandescent bulb of FIG. 1 are typically connected. One terminal of screw base 22 is axial eyelet 24 which is a concentric metal button. The other terminal of screw base 22 consists of metal shell 26 into which are formed threads 28.

Referring to FIG. 3, a conventional dual filament incandescent light bulb is illustrated. Bulb 29 houses a pair of filaments 30 and 32 which are mounted on lead wire pair 34 and 36 and lead wire pair 38 and 40, respectively. These lead wires are shown imbedded within evacuation tube 42 at its upper press 44. Referring to FIG. 4, a fragmentary elevational view along lines 4—4 of FIG. 3 is given. This view clearly illustrates the spacing between the lead wires 34 and 38. It is to be understood that lead wires 36 and 40 similarly are spaced but are hidden herein by lead wires 34 and 38, respectively. It can also be clearly seen from this figure that the press 44 of evacuation tube 42 has a split or forked cross-section.

Figure 7:
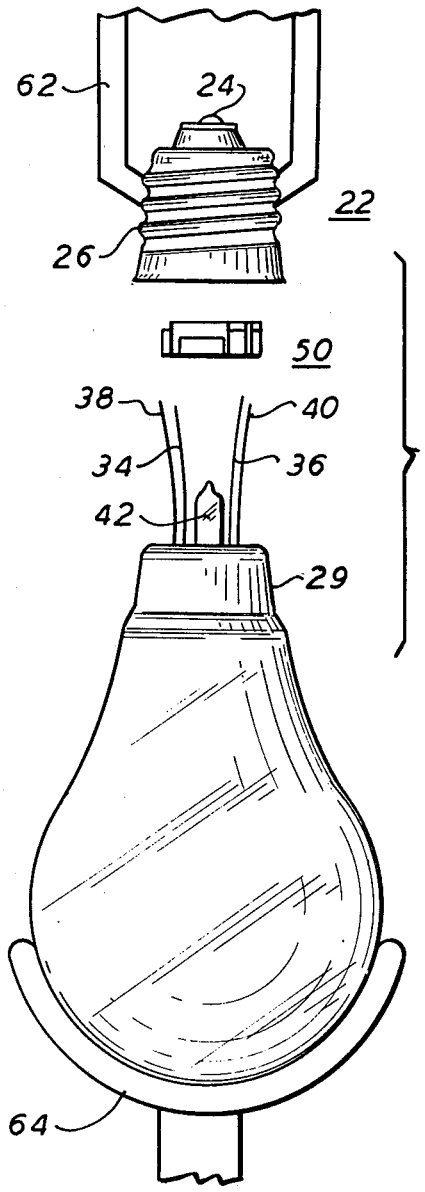
FIG. 7 is an exploded view of the apparatus of FIG. 5.

Referring to FIGS. 5 and 7, these figures show the installation of switching device 50 within screw base 22 adjacent bulb 29. It will be noted that bulb 29 is the dual filament bulb of FIG. 3. It will also be observed that when fully assembled, evacuation tube 42 is encompassed by switching device 50, in this embodiment. It can also be observed herein that screw base 22 mounts eyelet 24 on insulating layer 52 which caps a tapered insulator 54. Insulator 54 has a tapered axial aperture 56 through which lead wire 58 is routed. The metal shell 26 is bonded to bulb 29 by cement 60.

A placing member 62 (FIG. 7) is shown as part of the conventional assembly apparatus used in a production line to assemble screw base 22 and its associated switching device 50 to bulb 29. Bulb 29 is held in place by conventional fixture 64.

Referring now to FIG. 6, an exploded view is given of the switching device previously illustrated in simplified form in FIGS. 5 and 7. A frame is shown herein as a pair of complementary shells, comprising base 70 which can be sealed by a cover 72. In this embodiment shells 70 and 72 fit together to form a hollow chamber having two orthogonal branches. However, it will be appreciated that for other embodiments the frame can have other branched shapes including closed shapes such as a hollow toroid having a central aperture sized to receive the previously described evacuation tube. FIG. 10 shows such a toroidal frame wherein components corresponding to components in FIG. 6 have reference numerals increased by one hundred. In this embodiment of FIG. 6 the frame includes a crosspiece 74 which spans the two orthogonal branches of cover 72. Essentially, cover 72 is an "L" shaped plate having depending therefrom, two joined orthogonal walls 76 and 78. The purpose of the crosspiece 74 is to form a small, triangular opening with the "L" shape frame through which the exhaust tubing 42 is positioned, and to restrict any lateral movement of the frame, which might otherwise interfere with the installation of the lamp base during assembly. In addition, cover 72 has three downwardly depending tabs 80, 82 and 84 which hold cover 72 in position when mounted upon base 70. Base 70 has a floor 86 that has a general "L" shape. Floor 86 has four upstanding walls integrally attached to its edges, except for edges 88 and 90.

Mounted in side slit 92 is a fixed contact shown herein as a bent metallic tab 94 whose outer portion is connected to previously illustrated lead wire 40. It will be appreciated that other means for mounting tab 94 are possible including adhesive. In the embodiment of FIG. 9, an upright peg 92A in floor 86A, adjacent to an inside corner of frame 70A behind which bent tab 94A can be mounted. A moveable contact is shown in FIG. 6 as a continuous metal strip comprising a leading strip segment 96 and an oblique strip segment 98. Segments 96 and 98 are formed from a continuous strip which is bent into a U-shaped clip 100 at its mid-section. Clip 100 is slipped over edge 102 of frame 70. It will be appreciated, however, that in some embodiments oblique segment 98 may be omitted and that cantilevered segment 96 can be affixed in alternate manners including adhesive mounting or an upright peg as previously described in connection with fixed contact 94. Segments 96 and 98 are shown in a retracted or open position. These two segments would, if unrestrained, swing so that segment 96 electrically contacts fixed contact 94. However, segments 96 and 98 are held and restrained in the position illustrated by means of a fusible conductor, shown herein as thin wire 104. Conductor 104 is connected between the free end of cantilevered contact 96 and lead wire 36. A holding means is shown herein as aperture 106 in cover 72. Lead wire 36, and thus conductor 104 and contact 96, are restrained in the position illustrated by means of aperture 106 in cover 72. Essentially, the upright portion of lead wire 36 is routed through aperture 106 which then restrains that lead wire from lateral movement. Accordingly, so long as conductor 104 is intact, cantilevered contact 96 is restrained from deflecting back into electrical contact with fixed contact 94. It will be appreciated that other means for restraining conductor 104 are possible. For example, the end of conductor 104 opposite the free end of cantilevered contact 96, may be connected to a terminal which is molded into a side wall of base 70. When assembled, lead wire 58 is routed through matching notch 108 in cover 72.

When cover 72 is placed atop base 70, it and its walls 76 and 78 seal base 70 so that fragments from fusible conductor 104 are captured. Accordingly, fused fragments from conductor 104 cannot come into contact with an evacuated glass bulb and crack it. This is of great importance for otherwise the molten metal upon contact with the glass will likely crack the glass, cause leakage of air into the bulb and thus, burn out the filament.

Figure 8:
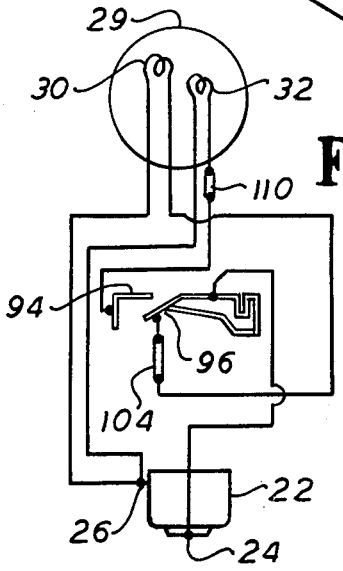
FIG. 8 is a schematic representation of the electrical connections associated with the apparatus of FIG. 5.

FIG. 8 is a schematic representation of the connection between filaments 30 and 32 to the previously described switching device and screw base. One terminal each of filaments 30 and 32 are connected to the metal shell 26 of screw base 22. Each remaining terminal of filaments 30 and 32 is connected to one end of fusible conductor 104 and fuse element 110, respectively. The other ends of conductors 104 and 110 are connected to cantilevered contact 96 and fixed contact 94, respectively. Fusible conductor 104 has been previously described. Fuse element 110 is similarly constructed and is welded in series with filament 32. Cantilevered contact 96 is also connected to the eyelet 24 of screw base 22.

To facilitate an understanding of the foregoing apparatus, its operation will be briefly described. As manufactured cantilever contact 96 is in the position shown in FIGS. 6 and 8. Accordingly, an electrical connection exists from eyelet 24 (FIG. 8) through fusible conductor 104 to one terminal of filament 30, the other terminal of filament 30 being commonly connected to the threaded metal shell 26 of screw base 22 (FIG. 8). It is well known that filament failure is frequently preceded by a gradual thinning of the cross-sectional area of the filament. Such thinning can be caused by migration of gasseous impurities towards a "hot" spot on the filament. Such a thinned cross-section causes a localized high resistance which creates a localized hot spot. At failure, as the filament separates a plasma state exists and thus causes a high flux of current to suddenly rush across the point of rupture. Accordingly, the fusible conductor is overheated and melted by the high current flowing through it. Accordingly, conductor 104 ruptures and allows cantilevered contact 96 to swing into contact with fixed contact 94. The swing of cantilevered contact 96 is motivated by release of its internal tension as well as the urging from oblique segment 98. Upon rupture of conductor 104 the connection between eyelet 24 and filament 30 terminates. Upon closure of contacts 94 and 96, eyelet 24 is connected through fusible conductor 110 to one terminal of filament 32. The other terminal of filament 32 being commonly connected to metal shell 26, current flows through filament 32. This sequence completes the substitution of filament 30 with filament 32.

Upon a similar failure of filament 32, an inrush of current melts fuse element 110. The melting of this conductor protects the main power lines and prevents excessive current.

The manufacture of the foregoing apparatus can be achieved with conventional hardware and manufacturing implements. Moreover, many of the components will be common to conventional lamps.

Referring to FIGS. 6 and 7, assembly proceeds by fitting switching device 50 over evaucation tube 42 while connecting lead wires 40 and 36 to fixed contact 94 and fusible conductor 104, respectively, within device 50. Next a connection is made between eyelet 24 of screw base 22 to cantilever contact 96 of device 50. Thus connected the remaining two lead wires 34 and 38 are connected to the threaded metal shell 26 of screw base 22. Finally, the screw base 22 is cemented onto the neck of bulb 10 in a conventional fashion. Thus assembled the device is ready for use and will operate in the manner previously described.

It is to be appreciated that modifications and alterations can be implemented with respect to the apparatus just described. For example, various materials can be used to fabricate the frame and its contact. It is anticipated that molded plastic or other insulators can be used to fabricate the frame. Moreover, the specific shape and dimensions of the various components can be altered as a matter of design. In addition, it is expected that the cantilevered contact can be motivated by its internal tension or alternatively, by a permanent magnet. In addition, various other materials of different dimensions can be substituted to provide the desired size, shape, wear, power handling capability, temperature stability, sensitivity to current surges etc. Obviously many other modifications and variations of the present invention are possible in light of the above teachings. It is therefore to be understood that within the scope of the appended claims, the invention may be practiced otherwise than as previously described.

What is claimed is:

1. In an electric light having a translucent or transparent bulb sealing at least two filaments that are coupled by lead wires into a screw base, said bulb having an evacuation tube coaxially located within said screw base, a filament switching device comprising:

a frame having a floor which branches in two directions, said frame being sized to fit within said screw base and branch around said evacuation tube;

a fixed contact attached to said frame;

a cantilevered contact attached to said frame and operable to deflect laterally over said floor, said cantilevered contact being positioned to flex upon separation from said fixed contact, said cantilevered contact being positioned to deflect transversely to said evacuation tube; and a fusible conductor, said frame including:

holding means for restraining one end of said conductor, its other end being connected to the free end of said cantilevered contact, said holding means being operable through said conductor to separate said cantilevered contact from said fixed contact.

2. In an electric light according to claim 1, wherein said frame comprises:

a pair of complementary shells shaped to fit together and encompass said fusible conductor and entrap fused fragments therefrom.

3. In an electric light according to claim 1, wherein said cantilevered contact and fusible conductor branch out in said two directions from their juncture.

4. In an electric light according to claim 3, wherein said said frame comprises:

a pair of complementary shells shaped to fit together and encompass said fusible conductor and entrap fused fragments therefrom.

5. In an electric light according to claim 4, wherein the outside of said frame is shaped to include an inside corner and wherein said frame includes:

a crosspiece bridging said inside corner to form a passageway sized to encircle said evacuation tube.

6. In an electric light according to claim 5, wherein said frame includes a holding aperture sized to receive a given one of said lead wires, said given one being connected to the end of said fusible conductor that is opposite said cantilevered contact, whereby the function of said holding means is provided by said holding aperture.

7. In an electric light according to claim 6, wherein said cantilevered contact comprises:

an oblique strip segment mounted on said frame; and a leading strip segment mounted on said frame and extending between said oblique segment and said fixed contact, said oblique segment being angled to urge said leading strip segment into electrical contact with said fixed contact, said fusible conductor being connected to said leading segment.

8. In an electric light according to claim 7, wherein said frame has a side slit and wherein said fixed contact comprises:

a tab inserted into said side slit.

9. In an electric light according to claim 8, wherein said two filaments each have a pair of lead wires and wherein said screw base has a first and second terminal, said first terminal being connected to said cantilevered contact, said second terminal being commonly connected to one of said lead wires from each of said two filaments, the two remaining lead wires being separately connected to said fixed contact and said fusible conductor.

10. In an electric light according to claim 4, further comprising:

a fuse element serially connected between said fixed contact and its associated filament.

11. In an electric light according to claim 4, wherein said frame comprises a hollow annulus, said fusible conductor being mounted within said annulus.

12. In an electric light according to claim 7, wherein said oblique and leading strip segments are formed from a single band folded at its mid-section into a U-shaped clip, said clip sized to fit over an edge of a corresponding one of said complimentary shells.

13. In an electric light having a translucent or transparent bulb sealing at least two filaments that are coupled by lead wires into a screw base, a filament switching device comprising:

a frame having a floor which branches to two directions, said frame having an internal peg projecting transversely to said two directions along the inside of said frame;

a fixed contact attached to said frame, said fixed contact comprising a tab mounted behind said peg;

a cantilevered contact attached to said frame and operable to deflect over said floor, said cantilevered contact being positioned to flex upon separation from said fixed contact; and a fusible conductor, said frame including:

holding means for restraining one end of said conductor, its other end being connected to the free end of said cantilevered contact, said holding means being operable through said conductor to separate said cantilevered contact from said fixed contact.

* * * * *

UNITED STATES PATENT AND TRADEMARK OFFICE

CERTIFICATE OF CORRECTION

PATENT NO. : 4,447,760

DATED : May 8, 1984

INVENTOR(S) : Ronald Koo

It is certified that error appears in the above-identified patent and that said Letters Patent is hereby corrected as shown below:

The sheets of Drawings consisting of Figures 9 and 10 should be added as per the attached.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*

UNITED STATES PATENT OFFICE

CERTIFICATE OF CORRECTION

Patent No. 4,447,760 Dated May 8, 1984

Inventor(s) Ronald Koo

It is certified that error appears in the above-identified patent and that said Letters Patent are hereby corrected as shown below:

FIG. 9

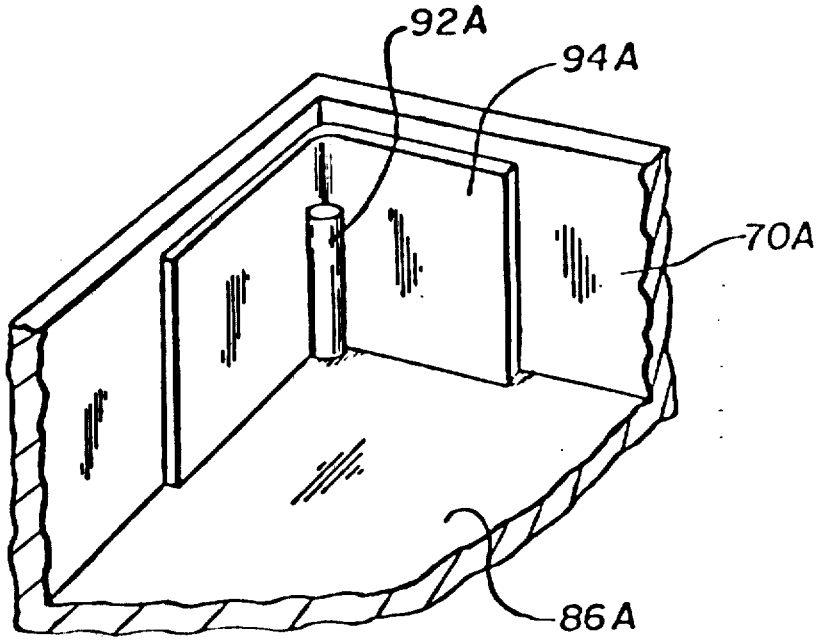

UNITED STATES PATENT OFFICE

CERTIFICATE OF CORRECTION

Patent No. 4,447,760 Dated May 8, 1984

Inventor(s) Ronald Koo

It is certified that error appears in the above-identified patent and that said Letters Patent are hereby corrected as shown below:

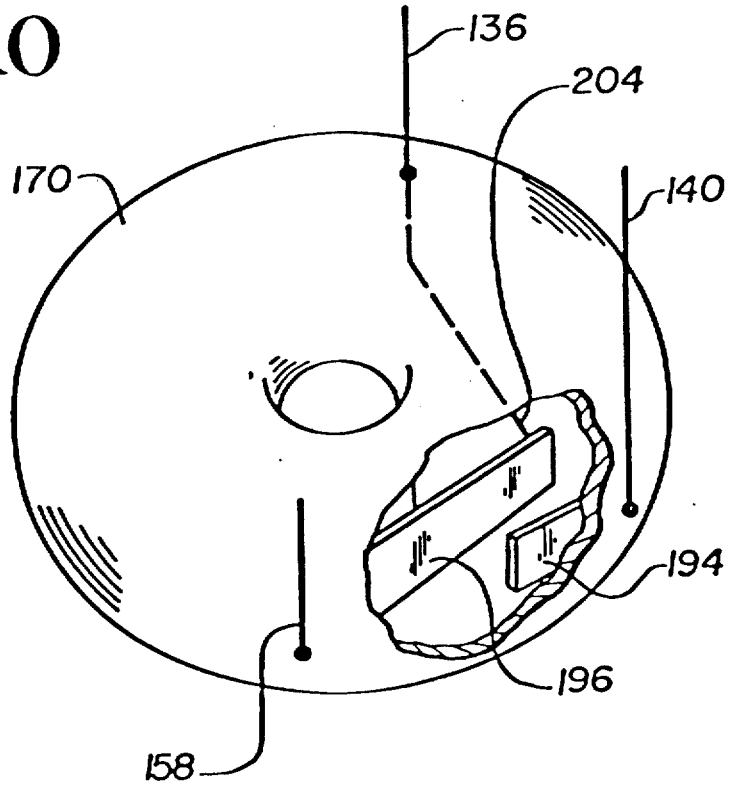

FIG.10